US008512066B2

(12) United States Patent
Lee

(10) Patent No.: US 8,512,066 B2
(45) Date of Patent: Aug. 20, 2013

(54) ELECTRIC WIRE CONNECTOR FOR PRESS CONNECTING ELECTRIC WIRES

(75) Inventor: Younghwan Lee, Gyeonggi-do (KR)

(73) Assignee: Jowoo-Tech Co. Ltd, Seoul (KR)

( * ) Notice: Subject to any disclaimer, the term of this patent is extended or adjusted under 35 U.S.C. 154(b) by 199 days.

(21) Appl. No.: 13/196,231

(22) Filed: Aug. 2, 2011

(65) Prior Publication Data

US 2011/0287657 A1 Nov. 24, 2011

Related U.S. Application Data

(63) Continuation-in-part of application No. 12/662,058, filed on Mar. 30, 2010, now Pat. No. 8,062,056.

(30) Foreign Application Priority Data

Sep. 17, 2009 (KR) ..... 10-2009-0087864

(51) Int. Cl.
*H01R 4/24* (2006.01)
*H01R 4/26* (2006.01)
*H01R 11/20* (2006.01)

(52) U.S. Cl.
USPC ..... 439/395; 439/409

(58) Field of Classification Search
USPC ..... 439/395, 396, 397, 409, 410, 402, 439/413, 417, 387, 446, 596, 820
See application file for complete search history.

(56) References Cited

U.S. PATENT DOCUMENTS

| | | | | |
|---|---|---|---|---|
| 1,290,153 | A | 1/1919 | Fitzpatrick | |
| 4,136,920 | A | 1/1979 | Scholtholt et al. | |
| 4,472,596 | A | 9/1984 | Brown et al. | |
| 4,538,869 | A * | 9/1985 | Richards | 439/596 |
| 4,684,195 | A | 8/1987 | Anderson et al. | |
| 4,722,699 | A | 2/1988 | Heng et al. | |
| 6,254,421 | B1 | 7/2001 | Denovich et al. | |
| 6,716,055 | B1 | 4/2004 | Echito | |
| 6,769,931 | B2 | 8/2004 | Negishi et al. | |
| 7,442,067 | B1 | 10/2008 | Amaral | |
| 7,867,013 | B2 | 1/2011 | Cox et al. | |
| 7,887,360 | B2 | 2/2011 | Andrade | |
| 8,062,056 | B2 * | 11/2011 | Lee | 439/395 |
| 2010/0068917 | A1 * | 3/2010 | Dennes et al. | 439/409 |

* cited by examiner

*Primary Examiner* — Hae Moon Hyeon
(74) *Attorney, Agent, or Firm* — Bacon & Thomas, PLLC

(57) ABSTRACT

An electric wire connector includes an insulative lower connector formed in a shape extending in a first direction, the lower connector being open at a top thereof, the lower connector being provided at sides thereof with a plurality of fixing protrusions and shaft openings, an insulative upper connector formed in a shape extending in the first direction, the upper connector being open at a bottom thereof, the upper connector being provided at sides thereof with fixing holes into which the fixing protrusions of the lower connector are inserted and a fixing shaft inserted through the shaft openings of the lower connector, and a conductive member disposed in the lower connector, the conductive member having a plurality of cutting blades for peeling off sheaths of electric wires, the cutting blades being electrically connected to cores of the electric wires.

8 Claims, 4 Drawing Sheets

ELECTRIC WIRE CONNECTOR FOR PRESS CONNECTING ELECTRIC WIRES

CROSS REFERENCE TO THE RELATED APPLICATION

This application is being filed as a continuation-in-part of Ser. No. 12/662,058 entitled electric wire connector, which was filed on Mar. 17, 2010.

BACKGROUND OF THE INVENTION

1. Field of the Invention

The present invention relates to an electric wire connector, and, more particularly, to an electric wire connector that is capable of connecting electric wires to each other without peeling off sheaths of the respective electric wires.

2. Description of the Related Art

Connection between two or more separate electric wires may be achieved using a method of peeling sheaths of the electric wires, connecting exposed cores of the electric wires, and wrapping the connected cores with an insulating tape.

In the method using insulating tape, however, a tool for twisting the cores of the electric wires is needed. Furthermore, the connection operation is complicated and troublesome. In addition, safety against electric shock is not guaranteed.

SUMMARY OF THE INVENTION

Therefore, the present invention has been made in view of the above problems, and it is an object of the present invention to provide an electric wire connector that is capable of rapidly and easily connecting a plurality of electric wires to each other without using a special tool and without peeling off sheaths of the respective electric wires.

In accordance with another aspect of the present invention, there is provided an electric wire connector including an insulative lower connector formed in a shape extending in a first direction, the lower connector being open at a top thereof, the lower connector being provided at sides thereof with a plurality of fixing holes, an insulative upper connector formed in a shape extending in the first direction, the upper connector being open at a bottom thereof, the upper connector being provided at an inside thereof with a plurality of guide hole parts protruding downward such that electric wires are inserted through the guide hole parts, the upper connector covering the lower connector, a plurality of fixing pieces disposed on the upper connector for fixedly pressing the upper connector through coupling between the fixing holes of the lower connector and fixing cores, and a conductive member disposed in the lower connector, the conductive member having a plurality of cutting blades for peeling off sheaths of the electric wires, the cutting blades being electrically connected to cores of the electric wires, wherein the conductive member has a plurality of bent parts formed by bending each end of the conductive member upward and downward so as to have increased contact area with the core of a corresponding one of the electric wires so that the conductive member can be properly used at high current and high voltage, a middle of each of the bent parts is cut out to form a groove, by which cutting blades opposite to each other are formed, and each of the cutting blades has a plurality of saw-toothed protrusions.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
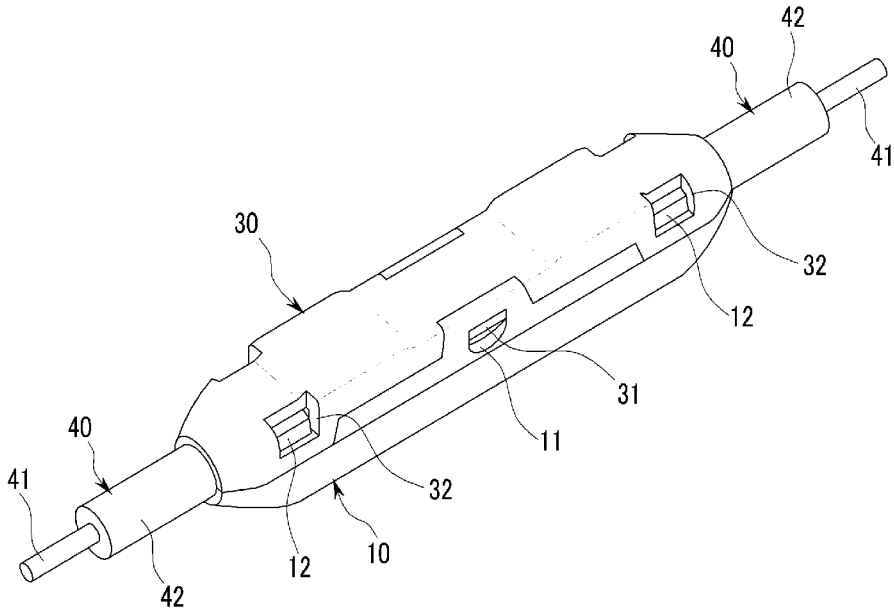
FIG. 1 is a perspective view illustrating an electric wire connector according to an embodiment of the present invention.

Now, preferred embodiments of the present invention will be described in detail with reference to the accompanying drawings such that the embodiments can be easily implemented by a person having ordinary skill in the art to which the invention pertains. However, the present invention may be implemented in various different forms, and therefore, the present invention is not limited to embodiments which will be described hereinafter. Also, parts having no connection with the present invention will be omitted from the drawings in order to more clearly describe the prevent invention, and similar reference numerals will be used throughout the specification to refer to similar parts.

Throughout the specification, when it is said that a certain part "includes" a certain element, this means that the part may further include other elements, not excluding them, unless otherwise mentioned.

An electric wire connector according to the present invention is formed by assembling an upper connector, a lower connector, and a conductive member disposed between the upper connector and the lower connector, and is configured in a structure to connect separate sheathed electric wires to each other without peeling off sheaths of the respective electric wires.

Hereinafter, electric wire connectors according to embodiments of the present invention will be described in detail with reference to FIGS. 1 to 5.

Figure 2:
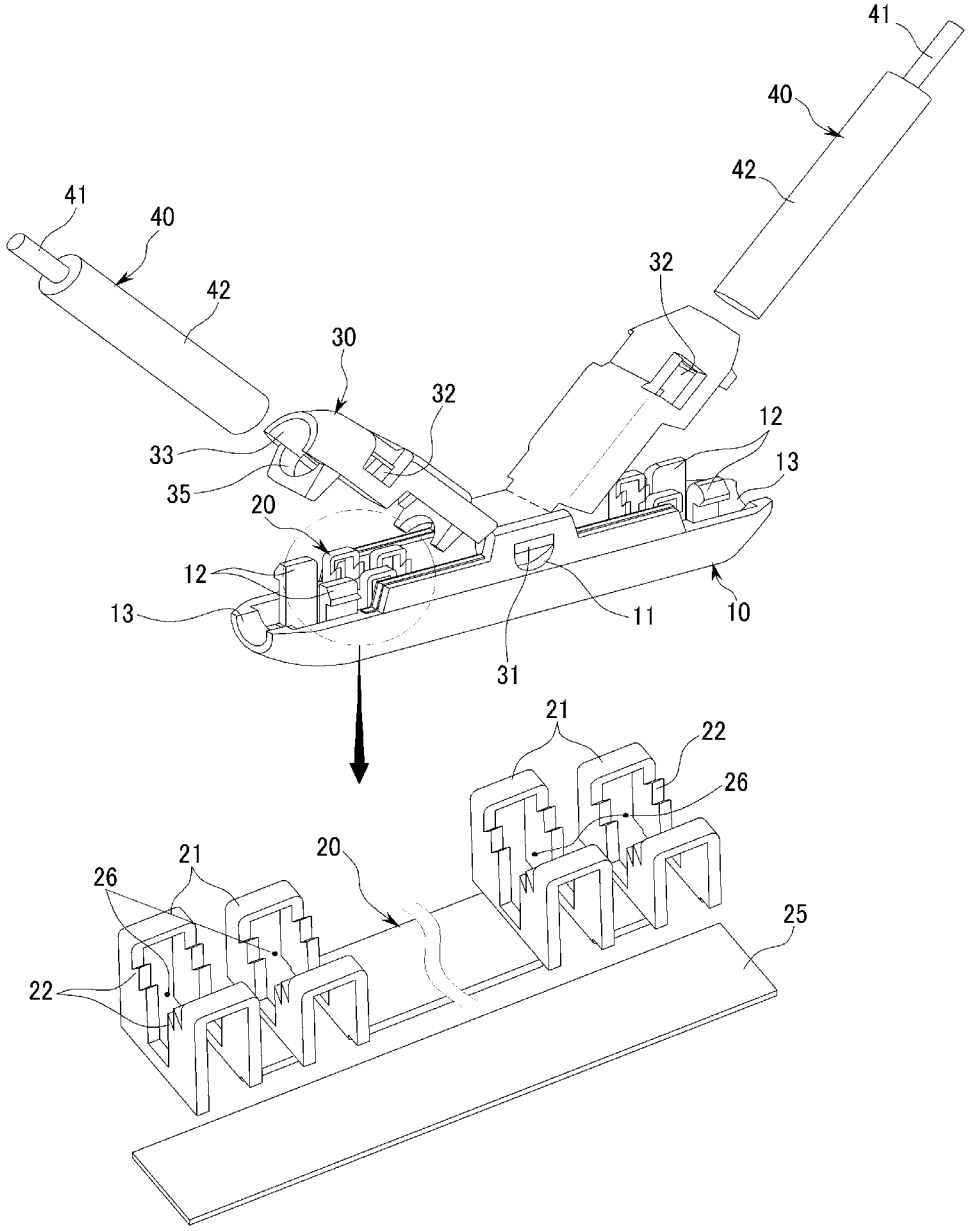
FIG. 2 is a perspective view of the electric wire connector shown in FIG. 1 illustrating a state in which an upper connector of the electric wire connector is open.
Figure 3:
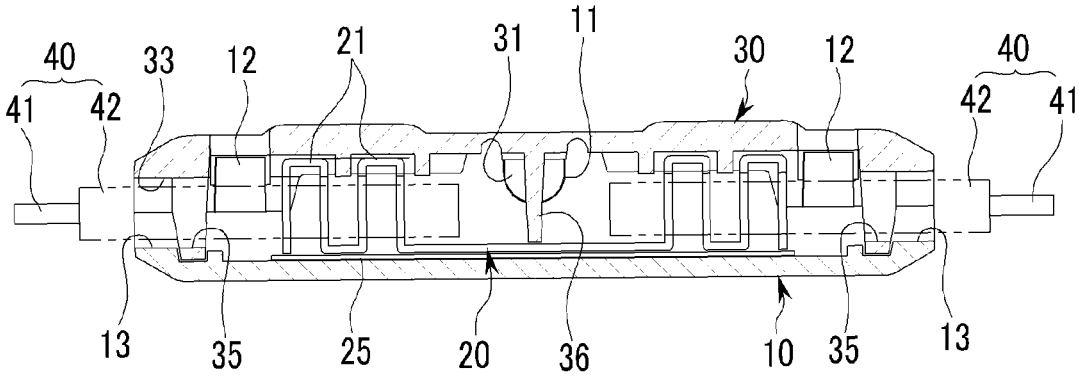
FIG. 3 is a sectional view of the electric wire connector shown in FIG. 1 after electric wires are inserted into the electric wire connector.

Referring to FIGS. 1 to 3, an electric wire connector according to an embodiment of the present invention includes a lower connector 10, an upper connector 30, and a conductive member 20.

The lower connector 10 is a receiving body which is open at the top thereof. The lower connector 10 is formed in a shape extending in the longitudinal direction thereof. The lower connector 10 has a space for receiving the conductive member 20 and electric wires 40 therein.

The lower connector 10 is provided at the front and rear ends thereof in the longitudinal direction thereof with hemispheric support grooves 13 for supporting the respective electric wires 40. The lower connector 100 has two sides opposite to each other between the front and rear ends thereof.

At opposite ends of the bottom of the lower connector 10 in the longitudinal direction thereof are formed pluralities of fixing protrusions 12 protruding upward and then bent outward from the upper ends thereof. The fixing protrusions 12 located at one side of the lower connector 10 are opposite to the fixing protrusions 12 located at the other side of the lower connector 10. For example, as shown in FIG. 2, four fixing protrusions 12 may be formed at the opposite ends of the lower connector 10.

Meanwhile, the lower connector 10 is provided at opposite sides of the middle thereof with shaft support parts 11 facing each other.

The shaft support parts 11 are formed in the shape of through holes formed through the opposite sides of the lower connector 10. A fixing shaft 31 of the upper connector 30 is inserted into the shaft support parts 11, with the result that the upper connector 30 is coupled to the lower connector 10.

The conductive member 20 has a plurality of bent parts 21 formed by bending each end of the conductive member 20 upward and downward so as to have increased contact area with a corresponding one of the electric wires 40 so that the conductive member 20 can be properly used at high current and high voltage. The middle of each of the bent parts 21 is cut out to form a groove 26, by which cutting blades 22 opposite to each other are formed.

The groove is formed in the shape of Y so that the respective cutting blades 22 are opposite to each other. That is, the cutting blades 22 are formed so that the distance between the cutting blades 22 at the upper ends thereof is large, the distance between the cutting blades 22 gradually decreases toward the lower sides of the cutting blades 22, and the distance between the cutting blades 22 is uniform from the middle parts to the lower ends of the cutting blades 22. Each of the cutting blades 22 is provided at the upper part thereof, at which each of the cutting blades 22 is opposite to a corresponding one of the cutting blades 22, with a plurality of saw-toothed protrusions.

The groove may be formed in the shape of V. The conductive member 20 is made of a conductive material, such as metal. For example, the conductive member 20 may be made of a copper alloy, such as phosphor bronze, exhibiting high strength and low denaturalization.

The conductive member 20 may have a predetermined thickness based on critical resistance of electric wires 40 to be coupled to the conductive member 20.

The conductive member 20 is further provided at the bottom thereof with a rectangular copper plate 25. The copper plate 25 is disposed at the lower connector 10, in a state in which the copper plate 25 is in tight contact with the conductive member 20, to reduce heat generated by abrupt electrical conduction occurring at contact points between the cutting blades 22 of the conductive member 20 and cores 41 of the respective electric wires 40. The copper plate 25 has the same width and length as the bottom of the conductive member 20.

Meanwhile, the upper connector 30 is a receiving body which is open at the bottom thereof. The upper connector 30 is formed in a shape extending in the longitudinal direction thereof. The upper connector 30 covers the lower connector 10 in which the conductive member 20 and the electric wires 40 are received.

The upper connector 30 is provided at the front and rear thereof with hemispheric support grooves 33 for supporting the respective electric wires 40. The upper connector 30 has two sides opposite to each other between the front and rear thereof in the longitudinal direction thereof.

At the two sides of the upper connector 30 are formed pluralities of fixing holes 32 into which the fixing protrusions 12 of the lower connector 10 are fixedly inserted. Also, the fixing shaft 31 is formed at each side of the middle of the upper connector 30 such that the fixing shaft 31 is fixedly inserted into the shaft support parts 11 of the lower connector 10.

The upper connector 30 is symmetric about the fixing shaft 31. The upper connector 30 has thin folding lines (indicated by dotted lines) by which the electric wire connector is opened such that the electric wires 40 can be inserted into the electric wire connector in a state in which the upper connector 30 is coupled to the lower connector 10.

Also, a plurality of guide hole parts 35 are formed at the inside top of the upper connector 30.

The guide hole parts 35 protrude such that the guide hole parts 35 are aligned with the fixing protrusions 12 of the lower connector 10. Specifically, one or more guide hole parts 35 are formed at at least one of the regions of the upper connector 30 divided about the fixing shaft 31.

The guide hole parts 35 have a larger diameter than that of the electric wires 40 such that the electric wires 40, inserted through the support grooves 33 and 13 of the upper and lower connectors 30 and 10, can be inserted through the guide hole parts 35.

The upper connector 30 is provided at the middle of the bottom thereof with a plate-shaped fixing piece 36 protruding downward for pressing the top of the conductive member 20 to fix the conductive member 20. The shape of the fixing piece 36 may be decided based on the shape of the conductive member 20.

The upper connector 30 and the lower connector 10 may be made of a plastic material exhibiting high elasticity to achieve coupling between the upper connector 300 and the lower connector 100 through coupling between the fixing protrusions 12 and the fixing holes 32 and coupling between the fixing shaft 31 and the shaft support parts 11.

In this embodiment, the electric wire connector connects the two electric wires 40 in an "I" shape. The electric wire connector is symmetric about the fixing shaft 31.

The electric wire connector is assembled as follows. First, as shown in FIG. 2, the conductive member 20 is placed in the lower connector 10.

At this time, the copper plate 25 is disposed at the bottom of the conductive member 20 in a state in which the copper plate 25 is in tight contact with the bottom of the conductive member 20, and the conductive member 20 is pressed by the fixing piece 36 of the upper connector 30 coupled to the lower connector 10.

The assembly of the upper connector 30 and the lower connector 10 is achieved by fixedly inserting the fixing shaft 31 of the upper connector 30 into the shaft support parts 11 of the lower connector 10.

When the opposite ends of the upper connector 30 are lifted upward about the folding lines of the upper connector 30 in this state, the inside top of the upper connector 30 is exposed.

In this state, two electric wires 40 are inserted into the electric wire connector such that the electric wires 40 are inserted through the exposed guide hole parts 35 located at the opposite ends of the upper connector 30.

After insertion of the electric wires 40 through the exposed guide hole parts 35, downward pressure is applied to the opposite ends of the upper connector 30 to achieve coupling between the upper connector 30 and the lower connector 10.

At this time, the fixing protrusions 12 of the lower connector 10 are coupled to the fixing holes 32 of the upper connector 30 to maintain the coupling between the upper connector 30 and the lower connector 10.

Upon completion of the coupling between the upper connector 30 and the lower connector 10, the guide hole parts 35 of the upper connector 30 are aligned with the cutting blades 22 of the conductive member 20. As a result, sheaths 42 of the electric wires 40 inserted through the guide hole parts 35 are removed by the cutting blades 22, and the cutting blades 22 penetrate into cores 41 of the electric wires 40 by a predetermined depth.

Consequently, one of the electric wires 40 and the other of the electric wires 40 are electrically connected to each other via the cutting blades 22, and, in addition, the electric wires 40 are securely fixed to the electric wire connector by the cutting blades 22.

At this time, the diameter of the sheathed electric wires 40 satisfies a predetermined range less than the diameter of the guide hole parts 35.

As can be seen from the above description, the electric wire connector shown in FIGS. 1 to 3 is an "I" type electric wire connector. When the upper connector 30 is pushed downward such that the upper connector 30 is coupled to the lower connector 10 in a state in which the two electric wires 40 are inserted through the guide hole parts 35 located at the opposite ends of the upper connector 30, the electric wires 40 are pressed downward, and the sheaths 42 of the respective electric wires 40 are peeled off by the saw-toothed cutting blades 22. In addition, the respective electric wires 40 are securely fixed to the electric wire connector by the saw-toothed cutting blades 22.

Hereinafter, an electric wire connector according to another embodiment of the present invention will be described in detail with reference to FIGS. 4 and 5.

The electric wire connector according to this embodiment of the present invention is used to connect two electric wires 65 to each other in a "T" shape. Specifically, the electric wire connector electrically connects a first electric wire 65 extending in one direction and a second electric wire 65 extending in the direction perpendicular to the first electric wire 65 to each other.

In the same manner as the "I" type electric wire connector, the "T" type electric wire connector includes a lower connector 50, a conductive member 55, and an upper connector 60. The structure of one side of the "T" type electric wire connector at which the first electric wire 65 is disposed is identical to that shown in FIG. 2, and therefore, a detailed description thereof will not be given.

At a region of the lower connector 50 where the second electric wire 65 connected perpendicularly to first electric wire 65 (in a 'T' shape) is disposed, the lower connector 50 is provided at opposite ends thereof extending in the shape of T unlike FIG. 1 with support grooves 53.

The conductive member 55 is provided at one end thereof with a plurality of bent parts 57 and cutting blades 57*a* formed by bending the conducive member 55 in the longitudinal direction. The conductive member 55 is provided at the other end thereof with bent parts 58 and cutting blades 58*a* extending in a "T" shape. In the same manner as the "I shape, grooves are formed at the middles of the bent parts 57 and 58 so that the cutting blades 57*a* and 58*a* are opposite to each other.

Each of the cutting blades 57*a* and 58*a* is formed in the shape of Y. That is, Each of the cutting blades 57*a* and 58*a* is formed so that the distance between the cutting blades 57*a* and 58*a* at the upper ends thereof is large, the distance between the cutting blades 57*a* and 58*a* gradually decreases toward the lower sides of the cutting blades 57*a* and 58*a*, and the distance between the cutting blades 57*a* and 58*a* is uniform from the middle parts to the lower ends of the cutting blades 57*a* and 58*a*. Each of the cutting blades 57*a* and 58*a* is provided at the upper part thereof, at which each of the cutting blades 57*a* and 58*a* is opposite to a corresponding one of the cutting blades 57*a* and 58*a*, with a plurality of saw-toothed protrusions.

The conductive member 55 is further provided at the bottom thereof with a T-shaped copper plate 59. The copper plate 59 is disposed at the lower connector 50, in a state in which the copper plate 59 is in tight contact with the conductive member 55, to disperse intensity of electric current supplied to the conductive member 55, thereby preventing the conductive member 55 from being damaged due high heat generated from the electric current. The copper plate 59 has the same width and length as the bottom of the conductive member 55.

Also, the upper connector 60 is provided at opposite sides thereof adjacent to one end thereof with support grooves 63 corresponding to the support grooves 53 of the lower connector 50. A pressing member (not shown) may be formed at the inner top of the upper connector 60.

Unexplained reference numeral 61 indicates shaft support parts and unexplained reference numeral 62 indicates a fixing shaft.

Figure 4:
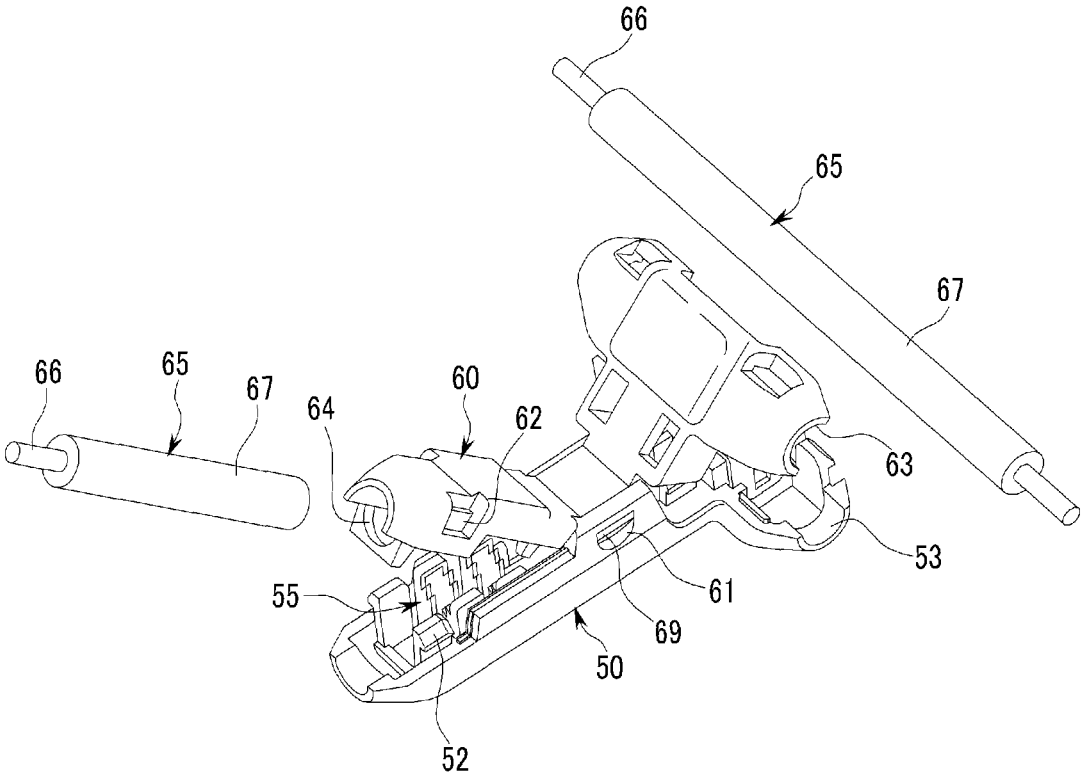
FIG. 4 is a perspective view illustrating an electric wire connector according to another embodiment of the present invention.
Figure 5:
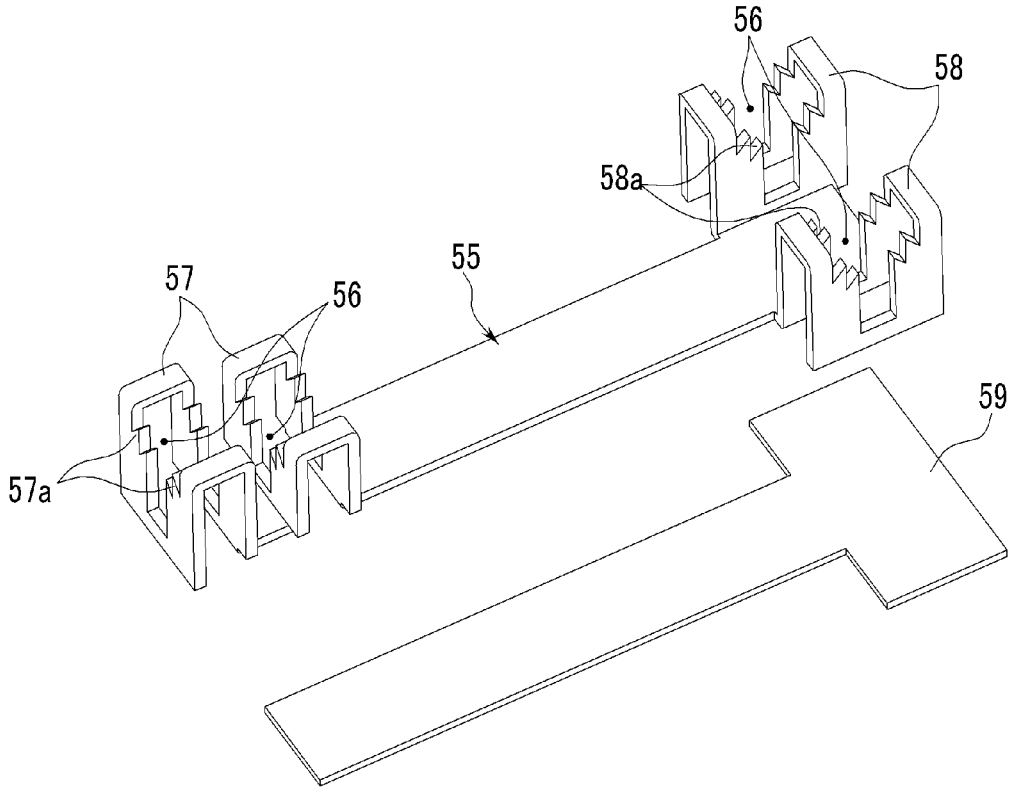
FIG. 5 is a perspective view illustrating a conductive member of the electric wire connector shown in FIG. 4.

The "T" type electric wire connector is assembled as shown in FIG. 4. The opposite ends of the upper connector 60 are lifted upward about folding lines (indicated by dotted lines in FIG. 4) of the upper connector 60, and then the first and second electric wires 65 are inserted into the upper connector 60.

At this time, the first electric wire 65 is inserted through guide hole part 64 of the upper connector 60 in the same manner as the previous embodiment. The second electric wire 65 is placed above the support grooves 53 of the lower connector 50, and the upper connector 60 is pushed downward. As a result, sheaths 67 of the first and second electric wires 65 are peeled off by the cutting blades 57*a* and 58*a*, and the cutting blades 57*a* and 58*a* penetrate into cores 66 of the electric wires 65 by a predetermined depth, thereby achieving electrical connection between the first and second electric wires 65 via the conductive member 55.

As can be seen from the above description, the cutting blades 58 are formed at the opposite sides of the conductive member 55 adjacent to one end of the conductive member 55, and the support grooves 63 and 50 are formed at the opposite sides of the upper and lower connectors 60 and 50 adjacent to one end of each of the upper and lower connectors 60 and 50, thereby achieving "T" type connection between the electric wires 65.

In the above description, it is defined and illustrated that two electric wires are connected to each other by the electric wire connector according to the present invention. Alternatively, it is possible to connect electric wires having a ratio of 1:N or N:M, and the structure of the electric wire connector according to the present invention may be variously modified accordingly.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An electric wire connector comprising:

an insulative lower connector (10) formed in a shape extending in a first direction, the lower connector (10) being open at a top thereof, the lower connector (10) being provided at a bottom thereof with a plurality of fixing protrusions (12) protruding upward, the lower connector (10) being provided at sides thereof with shaft support parts (11), the lower connector (10) being provided at front and rear ends thereof in a longitudinal direction thereof with support grooves (13) through which electric wires (40) are inserted, the electric wires (40) being supported by the support grooves (13);

an insulative upper connector (30) formed in a shape extending in the first direction, the upper connector (30) being open at a bottom thereof, the upper connector (30) being provided at sides thereof with fixing holes (32) into which the fixing protrusions (12) of the lower connector (10) are inserted and a fixing shaft (31) inserted through the shaft support parts (11) of the lower connector (10), the upper connector (30) being provided at front and rear ends thereof in a longitudinal direction thereof with support grooves (33) through which electric wires (40) are inserted, the electric wires (40) being supported by the support grooves (33), the upper connector (30) covering the lower connector (10); and a conductive member (20) disposed in the lower connector (10), the conductive member (20) having a plurality of cutting blades for peeling off sheaths of the electric wires (40), the cutting blades being electrically connected to cores (41) of the electric wires (40), wherein the conductive member (20) has a plurality of bent parts (21) formed by bending each end of the conductive member (20) upward and downward so as to have increased contact area with the core (41) of a corresponding one of the electric wires (40) so that the conductive member (20) can be properly used at high current and high voltage, a middle of each of the bent parts (21) is cut out to form a groove (26), by which cutting blades (22) opposite to each other are formed, and each of the cutting blades (22) has a plurality of saw-toothed protrusions.

2. The electric wire connector according to claim 1, wherein the groove (26) is formed in a shape of Y in which the respective cutting blades (22) are opposite to each other so that a distance between the cutting blades (22) at upper ends thereof is large, the distance between the cutting blades (22) gradually decreases toward lower sides of the cutting blades (22), and the distance between the cutting blades (22) is uniform from middle parts to lower ends of the cutting blades (22).

3. The electric wire connector according to claim 1, wherein the conductive member (20) is further provided at a bottom thereof with a rectangular copper plate (25), the copper plate (25) being disposed at the lower connector (10) in a state in which the copper plate (25) is in tight contact with the conductive member (20), the copper plate (25) having the same width and length as the bottom of the conductive member (20).

4. The electric wire connector according to claim 1, wherein the upper connector (30), the conductive member (20), and the lower connector (10) are symmetric about the fixing shaft (31).

5. The electric wire connector according to claim 1, wherein the upper connector (30) is provided at a middle of the bottom thereof with a fixing piece (36) for pressing the conductive member (20) to fix the conductive member (20).

6. An electric wire connector comprising:

an insulative lower connector (50) formed in a shape of T in which opposite ends of the lower connector (50) are perpendicular to each other, the lower connector (50) being open at a top thereof, the lower connector (50) being provided at a bottom thereof with a plurality of fixing protrusions (52) protruding upward, the lower connector (50) being provided at sides thereof with shaft support parts (61), the lower connector (50) being provided at front and rear ends thereof in a longitudinal direction thereof with support grooves (53) through which electric wires (65) are inserted, the electric wires (65) being supported by the support grooves (53);

an insulative upper connector (60) formed in a shape of T in which opposite ends of the upper connector (60) are perpendicular to each other, the upper connector (60) being open at a bottom thereof, the upper connector (60) being provided at sides thereof with fixing holes (62) into which the fixing protrusions (52) of the lower connector (50) are inserted and a fixing shaft (69) inserted through the shaft support parts (61) of the lower connector (50), the upper connector (60) being provided at front and rear ends thereof in a longitudinal direction thereof with support grooves (63) through which electric wires (65) are inserted, the electric wires (65) being supported by the support grooves (63), the upper connector (60) covering the lower connector (50); and a conductive member (55) disposed in the lower connector (50), the conductive member (55) having a plurality of cutting blades for peeling off sheaths of the electric wires (65), the cutting blades being electrically connected to cores (66) of the electric wires (65), wherein the conductive member (55) has a plurality of bent parts (57, 58) formed by bending each end of the conductive member (55) upward and downward so as to have increased contact area with the core (66) of a corresponding one of the electric wires (65) so that the conductive member (55) can be properly used at high current and high voltage, a middle of each of the bent parts (57, 58) is cut out to form a groove (56), by which cutting blades (57*a*, 58*a*) opposite to each other are formed, and each of the cutting blades (57*a*, 58*a*) has a plurality of saw-toothed protrusions.

7. The electric wire connector according to claim 6, wherein the groove (56) is formed in a shape of Y in which the respective cutting blades (57*a*, 58*a*) are opposite to each other so that a distance between the cutting blades (57*a*, 58*a*) at upper ends thereof is large, the distance between the cutting blades (57*a*, 58*a*) gradually decreases toward lower sides of the cutting blades (57*a*, 58*a*), and the distance between the cutting blades (57*a*, 58*a*) is uniform from middle parts to lower ends of the cutting blades (57*a*, 58*a*).

8. The electric wire connector according to claim 6, wherein the conductive member (55) is further provided at a bottom thereof with a T-shaped copper plate (59), the copper plate (59) being disposed at the lower connector (50) in a state in which the copper plate (59) is in tight contact with the conductive member (55), the copper plate (59) having the same width and length as the bottom of the conductive member (55).

* * * * *